US006391240B1

(12) United States Patent
Rackley

(10) Patent No.: US 6,391,240 B1
(45) Date of Patent: May 21, 2002

(54) PROCESS OF MAKING EXTRUDED BRUSH MONOFILAMENTS

(75) Inventor: Robert Lee Rackley, Parkersburg, WV (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/291,720

(22) Filed: Apr. 14, 1999

Related U.S. Application Data

(62) Division of application No. 08/842,308, filed on Apr. 24, 1997, now Pat. No. 5,933,906.

(51) Int. Cl.[7] ..... B26D 3/08; D01D 10/00; D02G 3/44; D02J 3/02

(52) U.S. Cl. ..... 264/145

(58) Field of Search ..... 264/145

(56) References Cited

U.S. PATENT DOCUMENTS

| | | | | |
|---|---|---|---|---|
| 3,118,161 A | | 1/1964 | Cramton | |
| 3,295,156 A | | 1/1967 | Brant | |
| 3,325,845 A | | 6/1967 | Sawkiw | |
| 3,506,535 A | | 4/1970 | Prevorsek et al. | |
| 3,984,514 A | | 10/1976 | Anderson et al. | |
| 4,279,053 A | | 7/1981 | Payne et al. | |
| 4,515,858 A | | 5/1985 | Bayan | |
| 4,610,925 A | | 9/1986 | Bond | |
| 4,656,073 A | | 4/1987 | Harris | |
| 4,719,150 A | | 1/1988 | Huber et al. | |
| 4,821,359 A | * | 4/1989 | Deziel et al. | 15/159.1 |
| 5,104,725 A | | 4/1992 | Broaddus | |
| 5,128,208 A | | 7/1992 | Bond et al. | |
| 5,523,155 A | | 6/1996 | Lin et al. | |
| 5,770,307 A | * | 6/1998 | Rackley et al. | 428/373 |

FOREIGN PATENT DOCUMENTS

| | | |
|---|---|---|
| DE | 50093 | 10/1966 |
| DE | 44 42 001 A1 | 6/1996 |
| EP | 450 210 A1 | 10/1991 |

* cited by examiner

*Primary Examiner*—Leo B. Tentoni
(74) *Attorney, Agent, or Firm*—Morgan & Finnegan, LLP

(57) ABSTRACT

Monofilaments with split ends. The monofilaments can be used to form toothbrush bristles having flagged or feathered tips. Each of the monofilaments has a plurality of internal fusion lines and at least four voids, wherein the voids comprise between 5 and 20% of the cross-sectional area of the monofilaments. Preferably, the monofilaments each have a diameter in a range of 0.0025 to 0.012 inches, and have a hexalocular or an octalocular configuration. The monofilaments are manufactured by extruding a plurality of thermoplastic polymeric streams, rotating a plurality of cutting blades above 1000 rpm, and placing a plurality of cutting blades in contact with end portions of the plurality of thermoplastic polymeric streams to form split ends.

15 Claims, 7 Drawing Sheets

PROCESS OF MAKING EXTRUDED BRUSH MONOFILAMENTS

This is a divisional of parent application Ser. No. 08/842,308, filed Apr. 24, 1997, now U.S. Pat. No. 5,933,906.

BACKGROUND OF THE INVENTION

1. Field of the Invention

This invention relates generally to monofilaments, and more particularly to monofilaments having split ends, which may be used for example as toothbrush bristles.

2. Description of the Related Art

Thermoplastic polymers have long been used to form brush bristles in a wide variety of configurations. To increase the effectiveness of these brushes, the ends of such bristles have been split or "feathered" to provide a soft bristle tip. In the past, however, various difficulties have been encountered in splitting bristle tips.

In particular, various techniques have been used to split paintbrush bristles to improve painting performance. Such procedures have been particularly suited to paintbrush bristles because long splits which propagate along a large portion (up to one inch) are particularly desirable. With certain brushes, however, only splitting of the tips is desirable. For example, the length of a typical toothbrush bristle is about (or less than) one half inch. If splitting were to occur along a large portion of a toothbrush bristle, the bristles would not be sufficiently rigid to adequately clean teeth. Accordingly, currently available splitting techniques fail to adequately address difficulties associated with splitting the tips of toothbrush bristles and other bristles in which long splits are undesirable.

SUMMARY OF THE INVENTION

This invention relates to a monofilament having a portion with a plurality of internal fusion lines and at least four voids, wherein the voids comprise between 5 and 20% of the cross-sectional area of the monofilament.

This invention also relates to a monofilament having a diameter in a range of 0.0025 to 0.012 inches, wherein the monofilament has a hexalocular, an octalocular, or a near circular shape.

In addition, this invention relates to a method of manufacturing extruded monofilaments having split ends, including the steps of extruding a plurality of thermoplastic polymeric streams to form a plurality of monofilaments, spinning a plurality of cutting blades above 1000 rpm, and placing a plurality of cutting blades in contact with end portions of the monofilaments to form split ends. In one embodiment of the present invention, the blades are spun at or near the natural frequency of the monofilaments.

DETAILED DESCRIPTION OF THE PREFERRED EMBODIMENTS OF THE PRESENT INVENTION

Figure 1A:
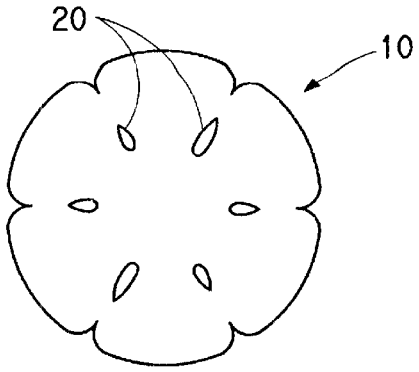
FIG. 1*a* is a cross-sectional view of a hexalocular monofilament of the present invention.
Figure 1B:
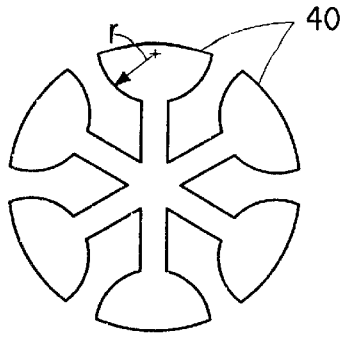
FIG. 1*b* is a cross-sectional view of a spinnerette capillary used to extrude the monofilament of FIG. 1*a*.

Which reference to the drawings, several embodiments of the present invention, and their corresponding method of manufacture, will now be described in greater detail. Which reference to FIGS. 1*a*, 2*a*, 3*a*, 4*a* and 5*a*, examples of a monofilament having a hexalocular shape are shown. Such shapes were achieved through an extrusion process using the respective spinnerette capillaries of FIGS. 1*b*, 2*b*, 3*b*, 4*b* and 5*b*. Such monofilaments were prepared by the fusion of six polymer streams. Each of these monofilaments 10 include a plurality of voids 20 and a plurality of weld or fusion lines. The voids result in a void content of between 5 and 20% of the cross-sectional area of the monofilaments.

The brush bristle of the present invention can be prepared from a wide variety of thermoplastic polymeric materials including polyamides, polyesters and polyolefins.

Polyamides for use in brush manufacturing including nylon 6,6, nylon 610 (polyhexamethylene sebaccamide), and nylon 612 (hexamethylene diamine). Polyesters which have been found particularly well suited to bristle manufacture include polybutylene terephthalate and polyethylene terephthalate. A polyolefin which has been found particularly well-suited to bristle manufacture is polypropylene.

The overall diameter, or overall maximum cross-sectional dimension, of the brush bristles of the present invention is in the range of 0.0025 to 0.012 inches (0.064 to 0.3 mm).

Figure 6A:
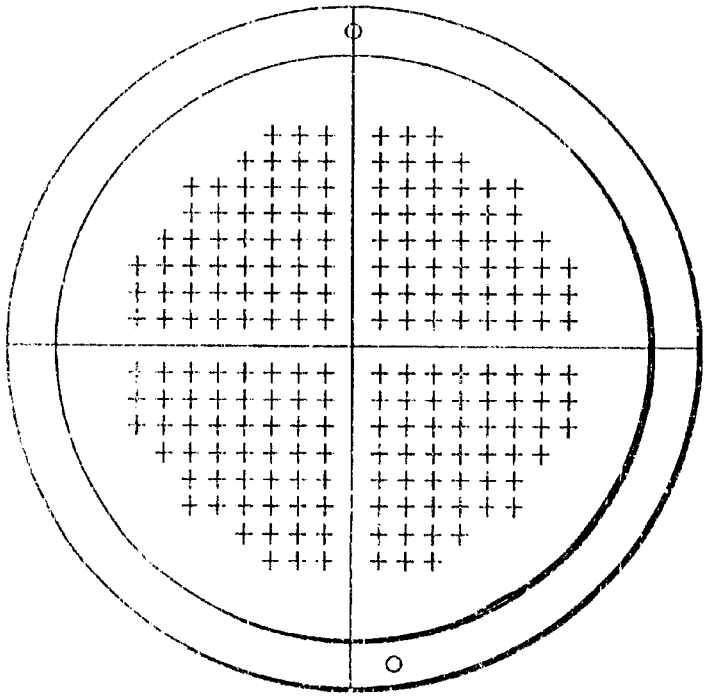
FIG. 6*a* is a front view of a spinnerette having a plurality of spinnerette capillary locations.
Figure 6B:
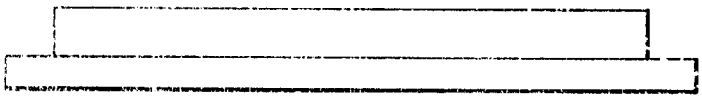
FIG. 6*b* is a side view of the spinnerette of FIG. 6*a*.

The bristles of the present invention are preferably formed by extruding six or more individual streams of polymeric material from a spinnerette including the spinnerette capillaries shown in FIGS. 1*b*, 2*b*, 3*b*, 4*b*, and 5*b*, and joining the streams to form a single filament. A spinnerette, such as the one shown in FIGS. 6*a* and 6*b*, includes a plurality of spinnerette capillaries. With reference to FIGS. 1*b*, 2*b*, 3*b*, 4*b*, and 5*b*, in the extrusion of the thermoplastic polymer streams, the polymer is extruded through openings 40. The fusion of the streams results in fusion lines at the interface of the individual streams, and the formation of longitudinal voids along the fusion lines. The general configuration of the voids can vary widely.

After extrusion of the thermoplastic polymer streams at elevated temperatures into a single filament, the monofilament is quenched and then drawn as generally described, for example, in U.S. Pat. No. 2,418,492, herein incorporated by reference.

After extrusion and quenching of the monofilament, the filament is oriented by stretching to improve the longitudinal strength. In addition, the filament can be subjected to other treatments to improve physical properties, such as treatment with saturated steam as described in U.S. Pat. No. 3,595,952, herein incorporated by reference.

The filament may be heat set after drawing for good bend recovery. The heat setting can be carried out either in a gas such as by blowing hot air over the filament, or a liquid bath such as by passing the filament through a bath of oil. The filaments are then cut into lengths suitable for brush manufacture. The individual bristles are then gathered into bundles, the bundles are tufted into brushes, and the brushes are tipped and flagged by a procedure described below.

Figure 7A:
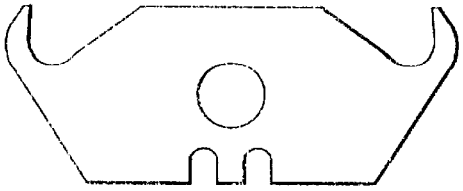
FIG. 7*a* is a plan view of a blade used in manufacturing a monofilament having split ends.
Figure 7B:
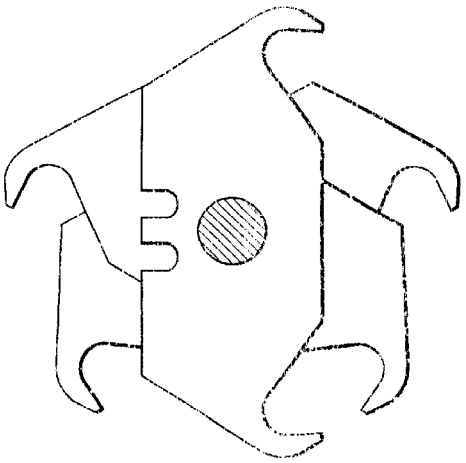
FIG. 7*b* is a front view of a structure having three blades mounted on a common shaft for use in splitting the ends of the monofilaments of the present invention.
Figure 7C:
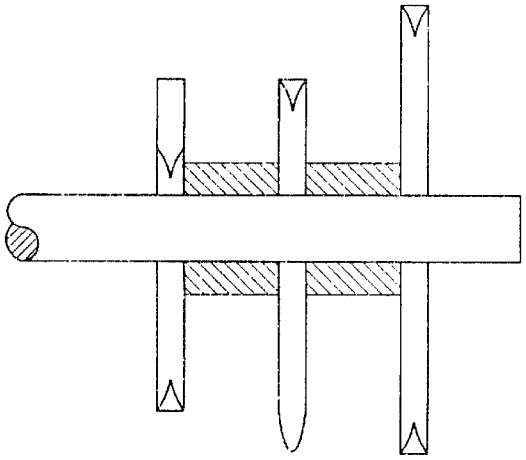
FIG. 7*c* is a side view of the structure of FIG. 7*b*.

With reference to FIG. 7*a*, a plan view of a cutting blade for use in splitting the ends of the bristle of the present invention is shown. An arrangement of three such blades which are separated by spacers on a common shaft by about 3/16 of an inch and which are approximately rotated from one another by 120 degrees is shown in FIGS. 7*b* and 7*c*. It has been found that by rotating such a blade above 1000 rpm and placing such a blade in contact with the bristles achieves a fine feathering (splitting) effect. In one example of the present invention, the blades are rotated at 30,000 rpm with a router motor. The interference between the bristle and the blade is varied depending on the depth of the split desired, although it has been found that 1/8 to 1/4 of an inch is preferable. Essentially, by spinning the blades at a high rate of speed and placing the blades in contact with the bristle tips, a fast and violent bristle cutting action is achieved, thereby causing optimal bristle splitting.

It has also been found that by rotating the blades at or near the natural frequency of a monofilament will obtain optimal splitting of the bristles. The natural frequency of a uniform beam is $$\text{Natural Frequency} = A\sqrt{\frac{EI}{\mu l^4}}$$

where A=3.52 for a cantilever beam;

$$I = \text{area moment of inertia} = \Pi\frac{d^4}{64};$$

E is Young's Modulus of Elasticity; $\mu$ is mass per unit length; and l=length. The natural frequency is usually stated in radians per second which can also be expressed in revolutions per minute by dividing by 2 $\pi$ and multiplying by 60 seconds per minute.

Figure 8:
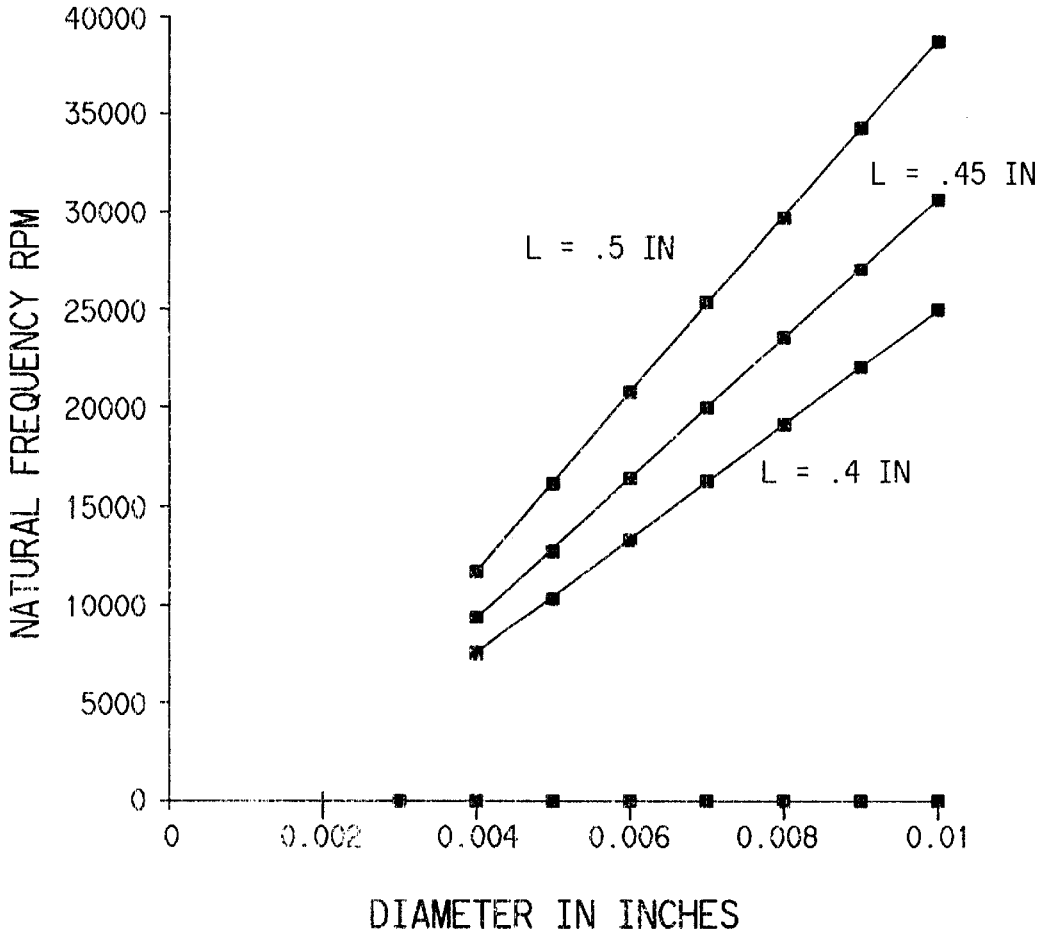
FIG. 8 is a graph of the natural frequency for a 612 monofilament with a 550,000 psi modulus and various lengths and diameters.

With reference to FIG. 8, a graph of the natural frequency for a 612 monofilament bristle with a 550,000 psi modulus and various lengths and diameters is shown.

The monofilament bristles of the present invention produce a larger number of smaller ends ("flags") than previously known monofilament bristles of the same diameter. The bristles exhibit excellent durability and cleanability, and are particularly useful as toothbrush bristles to produce remarkably soft, fine tips. By using such a technique, the bristles of the present invention are split rather than end rounded to give a plurality of smaller ends that scrub the gingival area more effectively. It has also be found that the more dense area achieved by such flagged ends scrub major tooth areas better by keeping toothpaste in contact with the tooth surface as well as achieving a softer feel when contact is made with soft tissue in the mouth.

Figure 9:
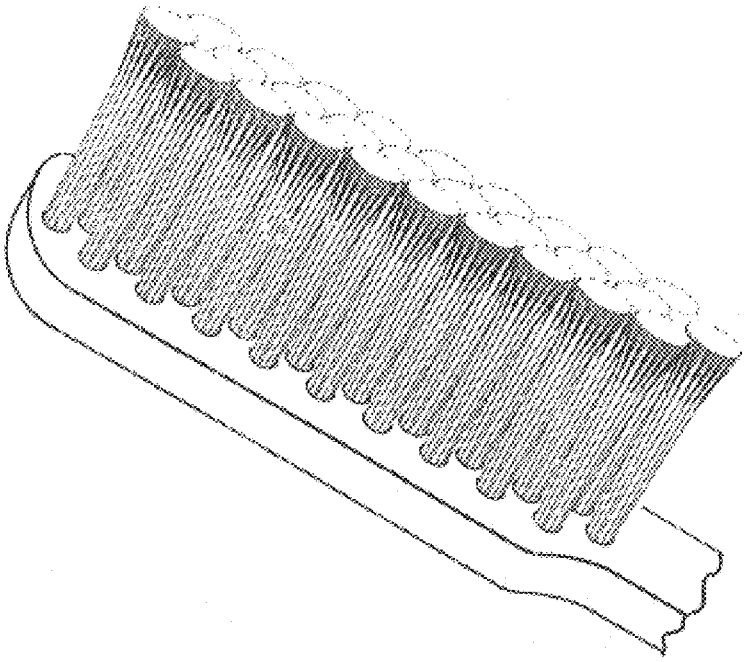
FIG. 9 is a perspective view of a toothbrush having a plurality of feathered bristles.
Figure 10:
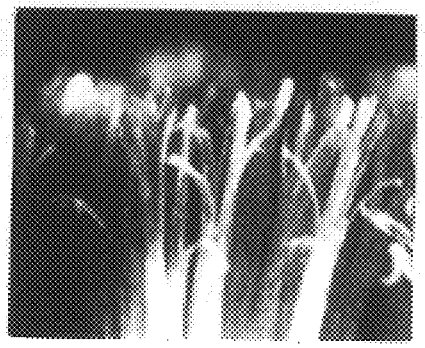
FIG. 10 is a side view of a plurality of bristles with split ends that produce a plurality of soft fine tips.
Figure 11:
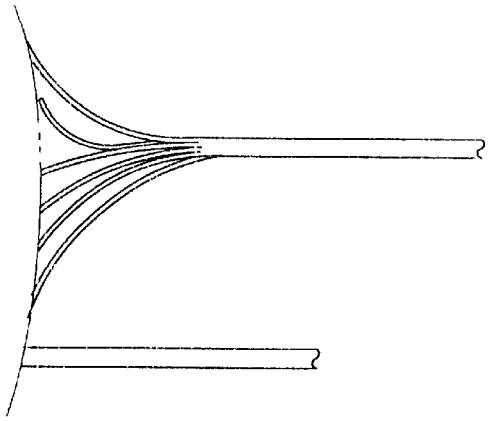
FIG. 11 is a side view of a comparison of a feathered toothbrush bristle which spreads-out on a tooth surface with an ordinary solid tip which provides only a single contact point.
Figure 12:
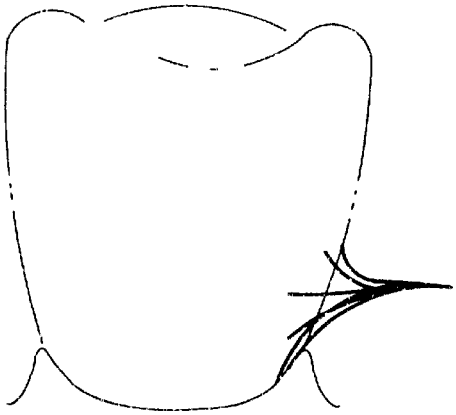
FIG. 12 is a view of feathered toothbrush bristles which penetrate deeper at the gum line for better cleaning without hurting the gum of a patient.

With reference to FIG. 9, a perspective view of a toothbrush having a plurality of feathered bristles is shown. With reference to FIG. 10, a plurality of bristles with split ends that produce a plurality of soft fine tips is also shown. These feathered filaments spread-out on tooth surfaces to provide a plurality of contact points, unlike ordinary solid tips which provide only one contact point. A comparison of these plurality of contact points to the single contact point of a solid tip is shown in FIG. 11. The fine feathered filaments of the present invention also produce a greater and deeper penetration at the gum line for better cleaning without hurting the gum line of a patient. Such deeper penetration at the gum line is shown in FIG. 12. Accordingly, these soft filament tips carry sweeping power action along with a beneficial interdental and gumline cleaning. In fact, it has been found that such feathered tips reach farther between teeth, provide better cleaning coverage than ordinary soft filament tips because of the increase in contact surfaces, and thus holds toothpaste in contact with teeth. Such an arrangement also provides a unique cushioning effect at the tips which adds extra softness to the brush. Such softness reduces bleeding of the gums during brushing. Moreover, such bristles have proven to be as hygienic as round filaments.

Figure 13:
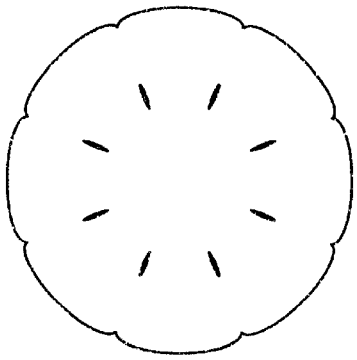
FIG. 13 is a cross-sectional view of an octalocular monofilament in accordance with the present invention.

Although the present invention has been described with reference to a hexalocular bristle structure having six voids, it has also been found that an octalocular bristle structure (having eight voids) provides numerous beneficial effects. Such an octalocular bristle is shown in FIG. 13. It is also to be understood that although six and eight streams have been used to achieve hexalocular and octalocular structures, respectively, a greater number of streams may be used to produce additional structures having a corresponding greater number of voids. The outer shape of such hexalocular, octalocular or other structures may be manufactured so as to have a circular or near circular shape. Such a near circular outer shape is shown in FIG. 13.

The percentage of the cross-sectional area occupied by the voids in the monofilaments is determined by the size, location, symmetry and shape of the voids. It has been found that a certain level of hollow space (voids) will result in an optimal splitting of brushes having relatively short lengths, such as toothbrushes. The voids optimally result in a void content of between 5 and 20% of the cross-sectional area of the monofilaments. With such brushes, if the voids are too small, such as the voids disclosed in U.S. Pat. No. 5,128,208, any feathering effect would result in broken bristle ends rather than in achieving feathering. If the voids are too large, such as the voids disclosed in U.S. Pat. No. 4,279,053, the bristle would feather easily, but the splits would likely propagate down the bristle during use. With use as a toothbrush bristle, it is important that the tips of the bristles be split without the split propagating down the filament, either during manufacture or use by a patient. This may also be true of other types of brushes, depending on the particular use of the brush and/or length of the bristles.

With regard to the location of the voids within the monofilament, the voids should be located about ½ way between the center and the outside edge. It has also been found that a longer and slender void achieves a greater flagging effect than a rounded void.

Figure 2A:
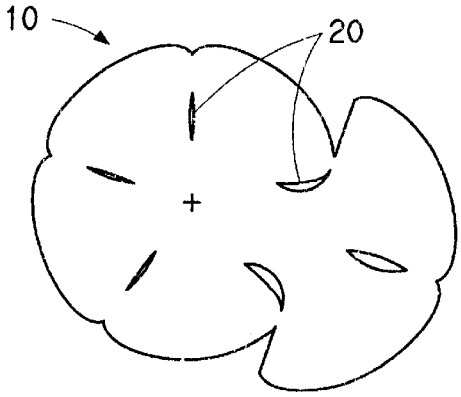
FIG. 2*a* is a cross-sectional view of another hexalocular monofilament of the present invention.
Figure 2B:
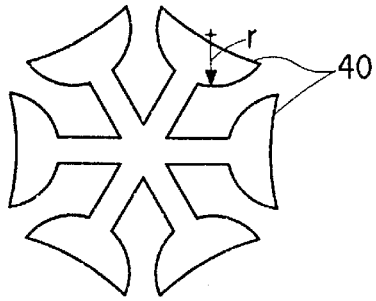
FIG. 2*b* is a cross-sectional view of a spinnerette capillary used to extrude the monofilament of FIG. 2*a*.
Figure 3A:
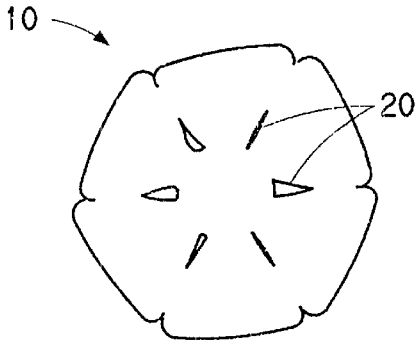
FIG. 3*a* is a cross-sectional view of another hexalocular monofilament of the present invention.
Figure 3B:
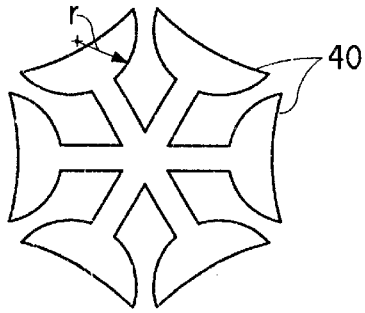
FIG. 3*b* is a cross-sectional view of a spinnerette capillary used to extrude the monofilament of FIG. 3*a*.
Figure 4A:
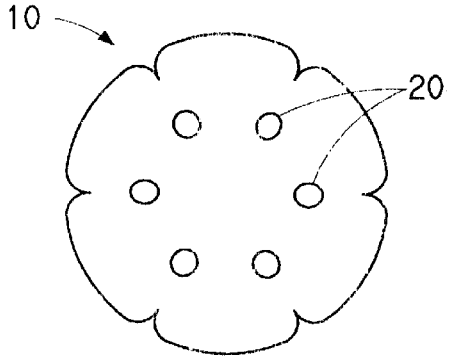
FIG. 4*a* is a cross-sectional view of another hexalocular monofilament of the present invention.
Figure 4B:
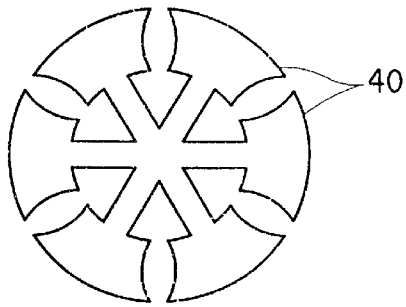
FIG. 4*b* is a cross-sectional view of a spinnerette capillary used to extrude the monofilament of FIG. 4*a*.
Figure 5A:
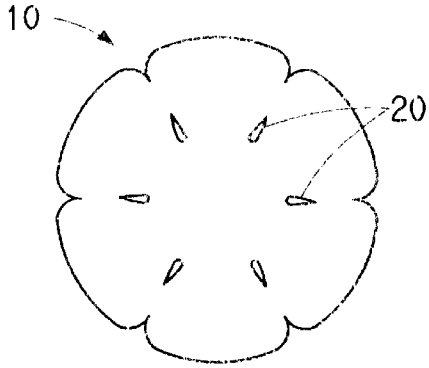
FIG. 5*a* is a cross-sectional view of another hexalocular monofilament of the present invention.
Figure 5B:
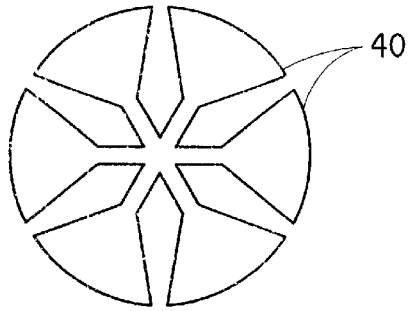
FIG. 5*b* is a cross-sectional view of a spinnerette capillary used to extrude the monofilament of FIG. 5*a*.

It is also to be noted that the voids may be either symmetrical or asymmetrical, although it is to be noted that an asymmetrical void may have a natural curvature which is often undesirable in particular uses, such as a toothbrush. Preferably, openings 40 of the spinneretteg, as shown in FIGS. 1*b*, 2*b*, 3*b*, 4*b* and 5*b*, have a radius of curvature r in the range of 5 to 12 mils. Openings 40 of the spinnerette capillary of FIG. 2*b* have an internal radius (or radius of curvature) of 9 mils, while the openings of the spinnerette capillary of FIG. 3*b* have a radius of 8 mils. Interestingly, use of the spinnerette capillary of FIG. 2*b* results in the asymmetrical monofilament of FIG. 2*a*, while use of the spinnerette capillary of FIG. 3*b* results in the symmetrical monofilament of FIG. 3*a*. It is important to note that the asymmetrical monofilament of FIG. 2*a* is not due to problems in the symmetry of the design, but with the large size of the lobes. With large lobes, the streams are not knitted together as the center is pulled. As such, insufficient space is left for two of the streams to be pulled into the monofilament.

The void content is determined on the basis of the weight of the hollow bristle and the weight of a hypothetical solid bristle of the same exterior configuration, according to the following formula:

$$\%\ \text{Void Content} = 100\left(1 - \frac{\text{weight of hollow bristle}}{\text{weight of solid bristle}}\right)$$

Although the present invention has been described in terms of certain preferred embodiments, other embodiments that are apparent to those of ordinary skill in the art are also intended to be within the scope of the present invention. Accordingly, the scope of the present invention is intended to be limited only by the claim appended hereto.

What is claimed is:

1. A method of manufacturing extruded brush monofilaments having split ends, comprising:

extruding a plurality of thermoplastic streams to form a plurality of brush monofilaments, wherein said extruding comprises extruding said thermoplastic streams through a spinnerette having a plurality of spinnerette capillaries, each of said spinnerette capillaries having a plurality of openings with a curved portion having a radius of curvature in the range of 5 to 12 mils;

rotating a plurality of cutting blades above 1000 rpm; and placing the plurality of cutting blades in contact with end portions of the brush monofilaments to form split ends.

2. The method of claim 1 wherein said spinning occurs at or about a natural frequency of said extruded brush filaments.

3. The method of claim 1 wherein said end portions are less than ¼ of an inch in length.

4. The method of claim 1 wherein said plurality of cutting blades are placed in contact only with the end portions of the brush monofilaments so that each of said brush monofilaments has an unsplit portion and a split portion, wherein said end portions are less than ¼ of an inch in length.

5. A method of manufacturing extruded brush monofilaments having split ends, comprising:

extruding a plurality of thermoplastic streams to form a plurality of brush monofilaments having a hexalocular or an octalocular configuration;

rotating a plurality of cutting blades above 1000 rpm; and placing the plurality of cutting blades in contact with end portions of the brush monofilaments to form split ends which are less than ¼ inch in length.

6. The method of claim 5 wherein said extruding comprises extruding said thermoplastic polymeric streams through a spinneratte.

7. The method of claim 5 wherein said extruding comprises extruding said thermoplastic polymeric streams through a spinnerette having a plurality of spinnerette capillaries, each of said spinnerette capillaries having a plurality of opening with a curved portion having a radius of curvature in the range 5 to 12 mils.

8. The method of claim 5 wherein spinning occurs at or about a natural frequency of said extruded brush monofilaments.

9. The method of claim 5 wherein said plurality of cutting blades are placed in contact only with the end portions of the brush monofilaments so that each of said brush monofilaments has an unsplit portion and a split portion.

10. A method of manufacturing extruded brush monofilaments having split ends, comprising:

extruding a plurality of thermoplastic streams to form a plurality of brush monofilaments having a plurality of internal fusion lines and at least four voids which occupy between 5 and 20% of a cross-sectional area of said monofilaments;

rotating a plurality of cutting blades above 1000 rpm; and placing the plurality of cutting blades in contact with end portions of the brush monofilaments to form split ends which are less than ¼ inch in length.

11. The method of claim 10 wherein said extruding comprises extruding a plurality of thermoplastic polymeric streams to form hexalocular or octalocular brush monofilaments.

12. The method of claim 10 wherein said extruding comprises extruding said thermoplastic polymeric streams through a spinnerette.

13. The method of claim 10 wherein said extruding comprises extruding said thermoplastic polymeric streams through a spinnerette having a plurality of spinnerette capillaries, each of said spinnerette capillaries having a plurality of openings with a curved portion having a radius of curvature in the range of 5 to 12 mils.

14. The method of claim 10 wherein spinning occurs at or about a natural frequency of said extruded brush monofilaments.

15. The method of claim 10 wherein said plurality of cutting blades are placed in contact only with the end portions of the brush monofilaments so that each of said brush monofilaments has an unsplit portion and a split portion.

* * * * *